United States Patent [19]

Bennington

[11] Patent Number: 4,921,387

[45] Date of Patent: May 1, 1990

[54] COMBINATION TRANSFER/TURNOVER MACHINE

[75] Inventor: Russell J. Bennington, Rochester Hills, Mich.

[73] Assignee: The Budd Company, Troy, Mich.

[21] Appl. No.: 245,720

[22] Filed: Sep. 16, 1988

[51] Int. Cl.[5] ..... B65H 1/00

[52] U.S. Cl. ..... 414/225; 414/751; 414/758; 414/779; 414/782; 414/783; 414/786; 198/468.6

[58] Field of Search ..... 414/788.5, 788.7, 222, 414/225, 729, 735, 751, 758, 773, 737, 752, 779, 782, 783, 786; 198/468.6

[56] References Cited

U.S. PATENT DOCUMENTS

| | | | |
|---|---|---|---|
| 730,424 | 6/1903 | Wenzel . | |
| 2,259,728 | 10/1941 | Bridges . | |
| 2,332,095 | 6/1944 | Grotnes . | |
| 2,904,192 | 9/1959 | Reynolds et al. . | |
| 3,342,125 | 9/1967 | Curran . | |
| 3,468,435 | 9/1969 | Ellwanger et al. . | |
| 3,651,955 | 3/1972 | Shkredka . | |
| 3,675,302 | 7/1972 | Dixon . | |
| 3,921,822 | 11/1975 | Dixon . | |
| 3,941,240 | 3/1976 | Rasenberger . | |
| 4,025,265 | 5/1977 | Auer . | |
| 4,056,198 | 11/1977 | Boserup | 414/773 X |
| 4,077,523 | 3/1978 | Spanke | 414/729 |
| 4,143,776 | 3/1979 | Meyers et al. . | |
| 4,251,957 | 2/1981 | Terahara | 414/225 X |
| 4,386,693 | 6/1983 | Bachman | 414/752 |
| 4,451,505 | 7/1984 | Lindbloom . | |
| 4,493,450 | 1/1985 | Yuzi . | |
| 4,547,115 | 10/1985 | Charbonnet . | |
| 4,643,634 | 2/1987 | Duina . | |
| 4,697,231 | 9/1987 | Boytor et al. . | |
| 4,727,976 | 3/1988 | Tsuchiya et al. | 198/468.6 X |
| 4,770,596 | 9/1988 | Sartorio | 414/735 X |
| 4,784,562 | 11/1988 | Kishi et al. | 414/225 |

*Primary Examiner*—Frank E. Werner
*Assistant Examiner*—James T. Eller, Jr.
*Attorney, Agent, or Firm*—Harness, Dickey & Pierce

[57] ABSTRACT

A combination transfer/turnover machine has a pair of double-acting transfer arms for quickly retrieving and inserting parts into a pair of metal stamping presses performing sequential operations on a workpiece. A turnover mechanism is provided for inverting the part during its transfer between machines. The transfer arm and turnover mechanism are all carried by a horizontally and vertically moveable bar mounted to a carriage. The entire apparatus can be mounted as a single unit to overhead support structure in a factory between the machines.

12 Claims, 5 Drawing Sheets

COMBINATION TRANSFER/TURNOVER MACHINE

BACKGROUND OF THE INVENTION

1. Technical Field

This invention relates to an apparatus and method for inverting and transferring parts between two workstations and, more particularly, for inverting the parts as well as transferring them.

2. Discussion

Transfer machines are used to automatically transfer parts between two workstations. These workstations can, for example, be two metal stamping presses which perform sequential operations on a workpiece. In some instances it is preferable for one of the presses to operate on an opposite side of the workpiece. Thus, it becomes necessary to turnover or invert the workpiece 180° about a horizontal axis.

Various attempts to accomplish this function have been made. U.S. Pat. No. 3,921,822 to Dickson generally discloses a machine having jaws which pick up a part at a loading station and place the part at a delivery station. The machine may be adapted to turn the part over, end over end, during its transfer between the stations. In U.S. Pat. No. 2,904,192 to Reynolds et al a transfer device is disclosed for light bulbs that inverts the bulb during its travel. U.S. Pat. No. 3,941,240 discloses grippers which engage and invert the workpiece. U.S. Pat. No. 4,493,450 to Yuzui likewise discloses machinery that inverts the part. The patent to Wenzel (U.S. Pat. No. 730,424) generally discloses a rack and gear arrangement for inverting bottles.

U.S. Pat. No. 3,342,125 to Curran generally discloses apparatus for reversing a workpiece in an automated press line. Some of the disadvantages of the approach taken in this patent are that the turnover equipment is connected to the presses in such a manner that it cannot be easily removed to obtain access to the presses for die changeover purposes and the like. In addition, this prior approach is not easily modified to accommodate different parts nor is it easily moveable to different locations within the production plant.

SUMMARY OF THE INVENTION

In accordance with the teachings of the preferred embodiment of this invention, a transfer machine is provided for transferring a part between two machines. The apparatus includes a horizontal bar connected to a vertically and horizontally moveable carriage. A first transfer means on one end of the bar is provided for picking up a part in one machine and depositing it at a first deposit station located between the machines. A second transfer arm on the other end of the bar serves to pick up the part from a second deposit station and place it into the second machine. Third means, carried by the bar between the two transfer arms, is provided for picking up a part at the first deposit station and depositing it at the second deposit station. In one embodiment, the third means is adapted to invert the part while transferring it between the two deposit stations. As will appear, the machine is easily moved within the production plant as necessary and can be readily modified for use with different parts.

BRIEF DESCRIPTION OF THE DRAWINGS

FIG. is a front plan view of apparatus made in accordance with the teachings of the preferred embodiment of this invention.

DESCRIPTION OF THE PREFERRED EMBODIMENT

Figure 1:
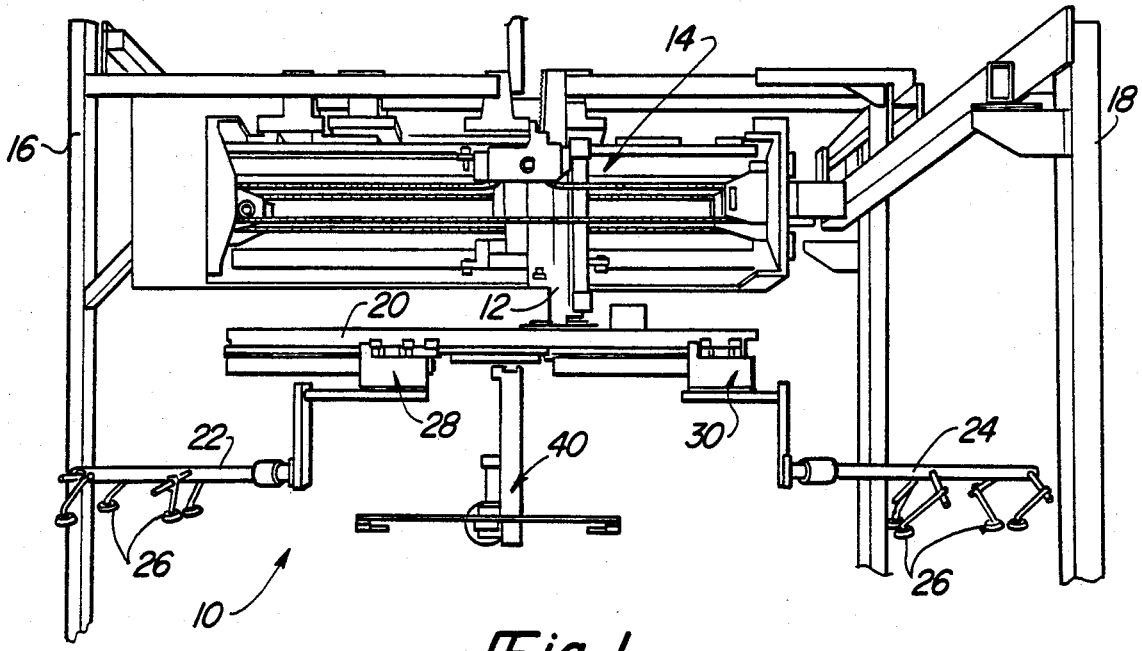
Figure 2:
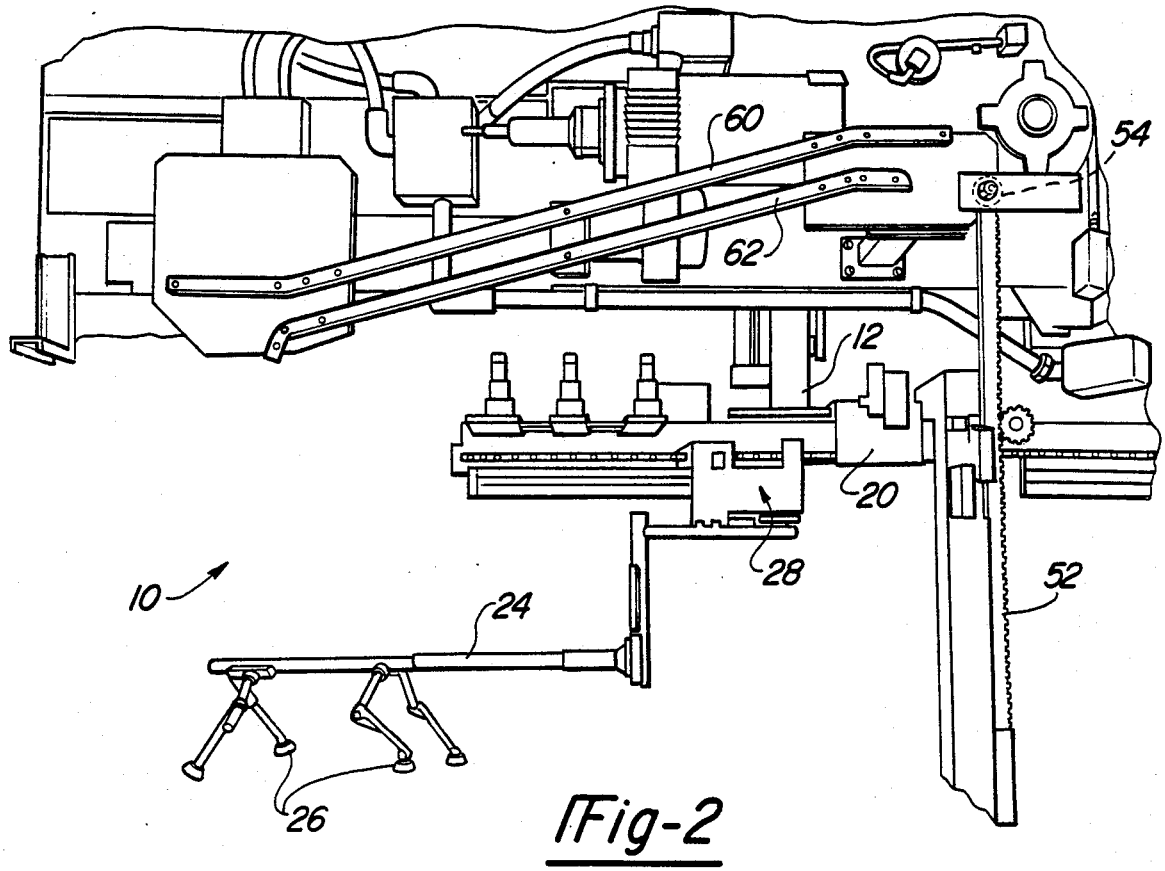
FIG. 2 is a perspective, somewhat schematic view taken from the rear of the apparatus shown in FIG. 1.
Figure 3:
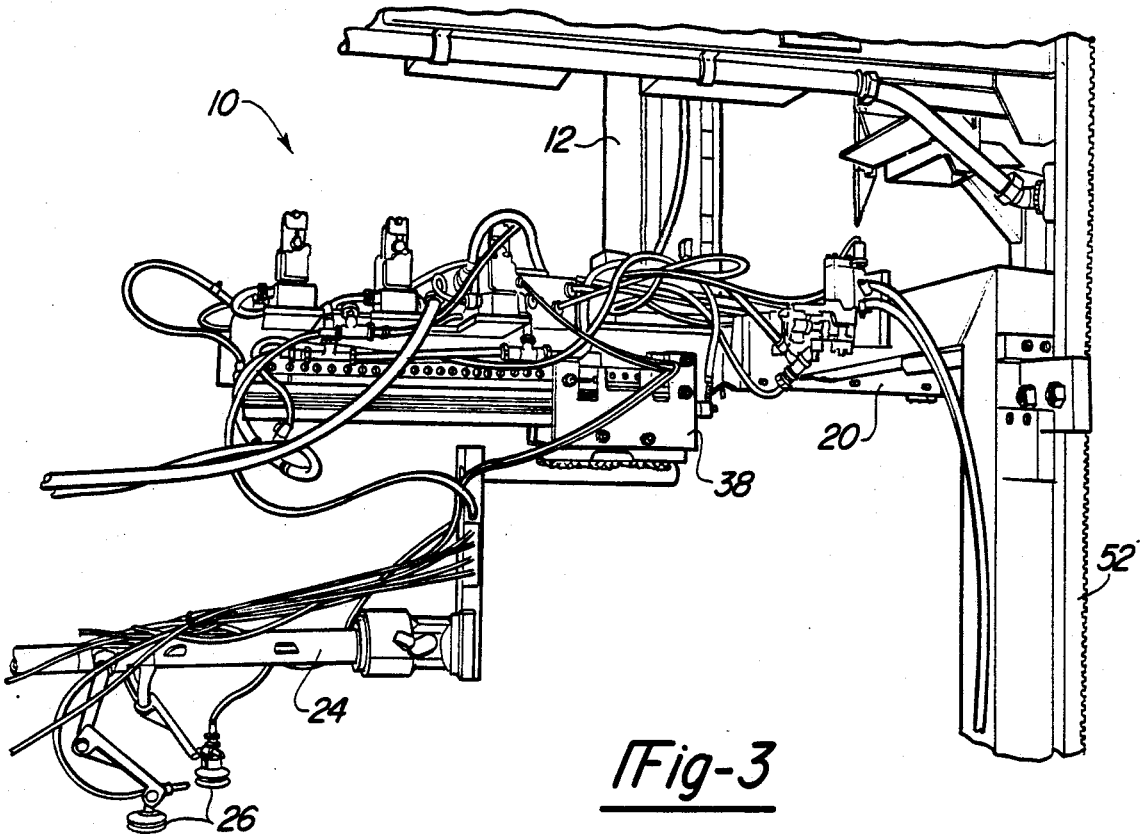
FIG. 3 is also a perspective view taken from the rear of the apparatus as viewed from one side, this view including many of the details of the pneumatic hose connections not shown in FIG. 2.

The details of the combination transfer/turnover machine 10 are illustrated in FIGS. 1–4. Many of the details, such as pneumatic hose connections, mounting brackets and the like are self explanatory and therefore need not be described in this text in order for the person of ordinary skill in the art to understand the invention.

Provision is made for vertically and horizontally moving a carriage 12 under control of a suitable programmable controller. The movement of carriage 12 is preferably provided by way of a drive mechanism that can be suspended between the two machines between which the parts are to be transferred by the apparatus 10. In this embodiment, an electric chain drive 14 is employed. The chain drive 14, per se is of conventional design such as that provided by an ULTIMAX II dual motion programmable loader/unloader made by Clearing Mfg. Co. of Chicago, Ill. Thus, the details of the chain drive 14 need not be discussed herein. Suffice it to say that the drive 14 includes electric motors under programmable control that drive suitable gearing arrangements cooperating with the chains to cause the desired vertical and/or horizontal movement of the carriage 12. In FIGS. 1–4, the drive 14 is suspended between frames 16 and 18. However, it is preferable that the entire apparatus 10 be suspended from an overhead gantry as commonly found in a production factory as illustrated, for example, in FIG. 5.

A horizontal bar 20 is connected to the carriage 12 and moves with it. A pair of transfer arms 22 and 24 are located on opposite lower ends of the bar 20. Means are provided on each transfer arm to pick up and carry the workpiece. In this embodiment, each arm includes a plurality of fingers having vacuum suction cups 26 thereon for temporarily gripping the workpiece. As is known in the art, when vacuum is applied to cups 26, they operate to hold the part onto the arm so that it can be carried by it, and when the vacuum ceases, the part is released.

Figure 12:
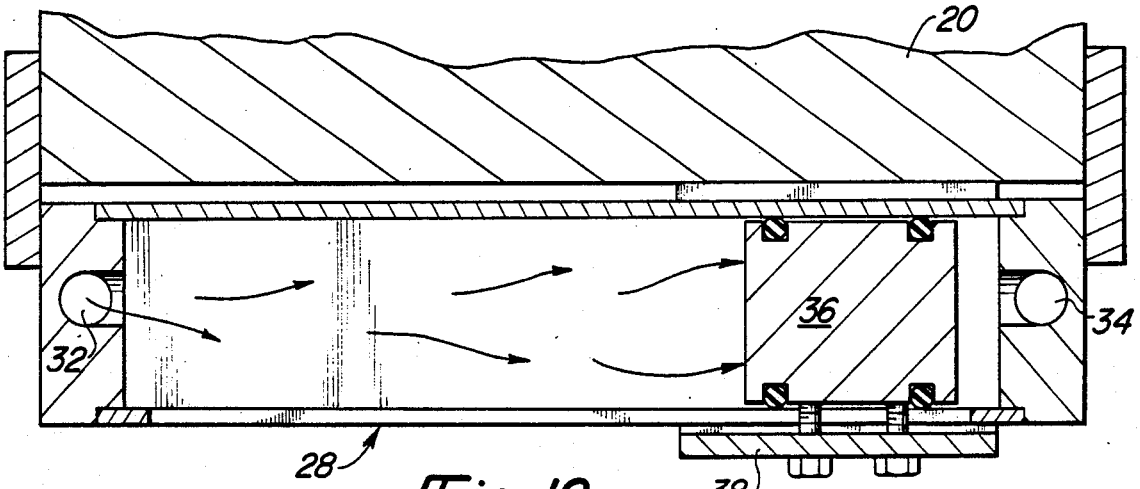
FIG. 12 is a cross-sectional view taken along the lines 12—12 of FIG. 5.
Figure 13:
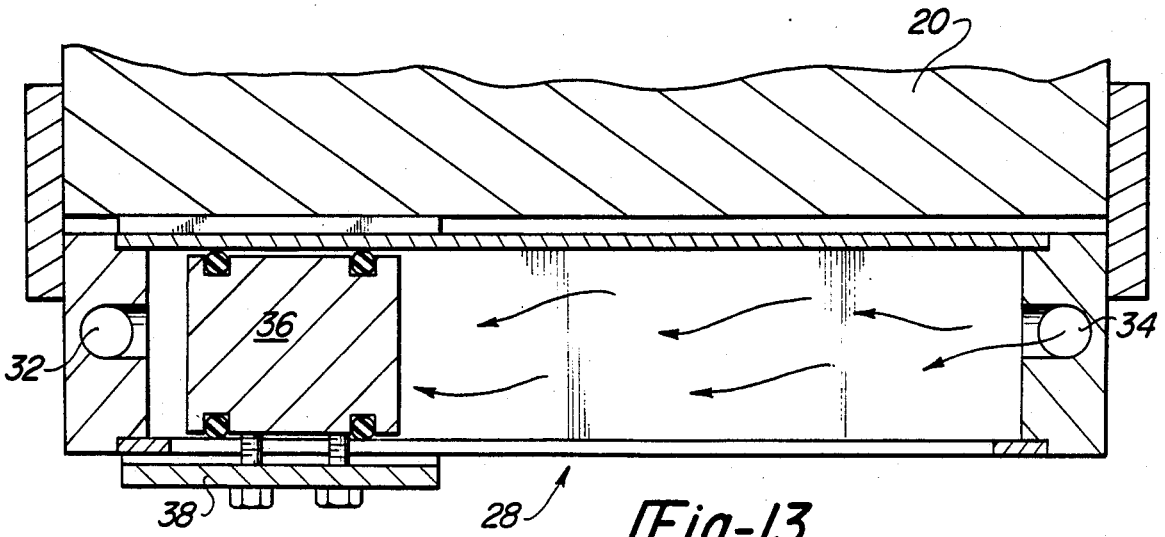
FIG. 13 is a cross-sectional view taken along the lines 13—13 of FIG. 6.

Apparatus advantageously includes a double-acting feature for each of the transfer arms 22 and 24. In other words, each of the arms can be moved along with the bar 20 and, in addition, they can move relative to the bar 20 under the control of actuators 28 and 30, respectively. The purpose of actuators 28 and 30 is to enable the arms 22 and 24 to be moved very quickly. As will appear, this will enable more efficient transfer of the parts between the two workstations. Various actuating designs may be employed. FIGS. 12 and 13 illustrate an acceptable pneumatic design. Here, air pressure selectively applied to ports 32 or 34 cause piston 36 to move to the right or left carrying with it bracket 38 connected to the transfer arm 22. On the other hand, the actuators may be driven by a ball/screw drive which is currently presently preferred.

Transfer bar 20 also carries a turnover mechanism 40. Turnover mechanism 40 is connected to lower portions of the bar 20 between the two arms 22 and 24. Turnover mechanism 40 is perhaps best shown in FIG. 4 as including a gripper 42 having a pair of gripping jaws 44, 46 which open and close about the workpiece in any suitable manner. As illustrated, the jaws operate in a scissors like action, each being pivoted at an intermediate point 48 under the control of the cylinder 50. Other suitable drive arrangements for the jaws can also be used such as a rack and pinion type mechanism. The gripping jaws are designed for a particular part configuration and can be easily replaced by another jaw design to accommodate differently shaped parts. In most other respects the machine 10 need not be modified even though the part changes.

Figure 4:
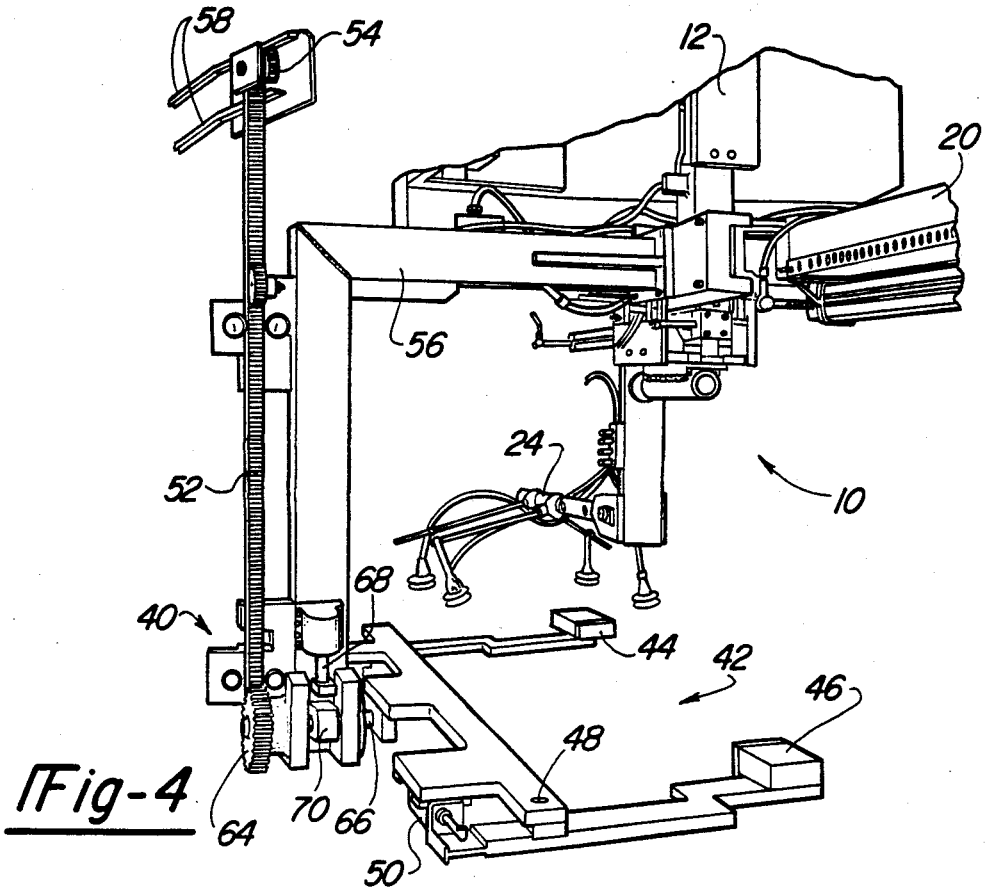
FIG. 4 is a partial perspective view of parts of the rear of the apparatus when viewed from a side opposite to that viewed in FIG. 3.

Means are provided for driving the gripper 42 in such manner that it will rotate 180° during horizontal movement of transfer bar 20 to thereby invert the part being gripped. The gripper drive includes a vertically extending rack 52 having a wheel at one end serving as a cam follower 54. Rack 52 is suitably connected to the arm 20 via bracket 56 so that it moves horizontally with the bar 20. During a portion of its horizontal travel, the cam follower 54 enters and follows a stationary cam track 58. As shown best in FIG. 2, cam track 58 includes a pair of open ended inclined rails 60 and 62 which are stationarily fixed via brackets to the chain drive 14. When the cam follower 54 is in the cam track 58, rack 52 moves vertically as the bar 20 moves horizontally. The lower portion of rack 52 engages a drive pinion 64. Vertical movement of rack 52 causes pinion 64 to turn shaft 66 which, in turn, is connected to gripper 42. As will appear, turnover mechanism 40 thus operates to invert the part held by gripper 42 as the bar 20 moves horizontally. If desired, a suitable brake can be employed to ensure exact 180° rotation. A selectively energizable piston rod 68 engaging an appropriately shaped block 70 on shaft 66 is illustrated in FIG. 4 for this purpose.

Figure 5:
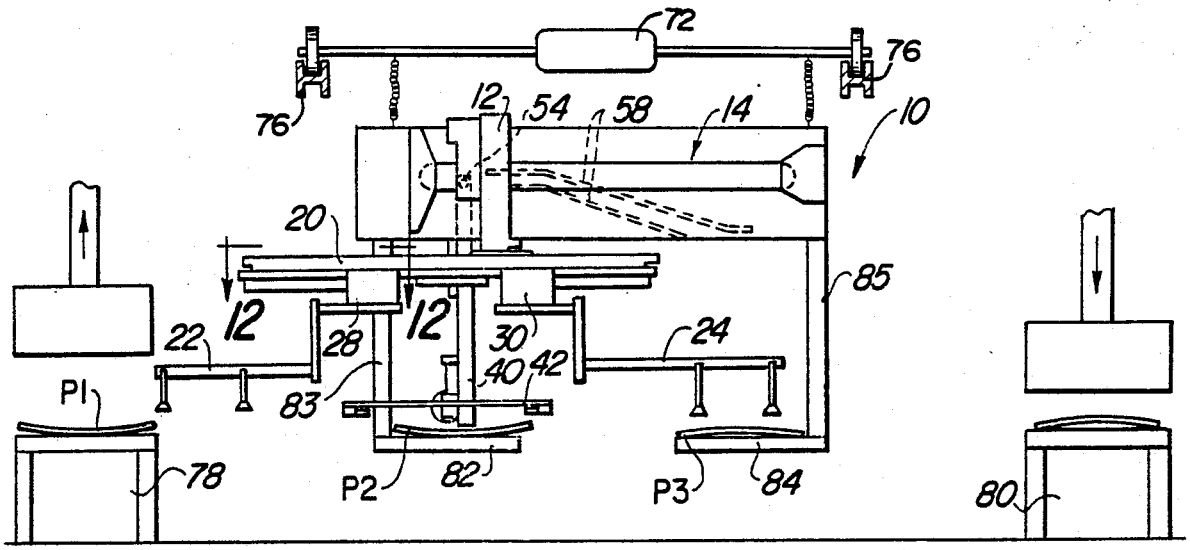
FIGS. 5–9 schematically illustrate a sequence of steps during operation of the apparatus.
Figure 6:
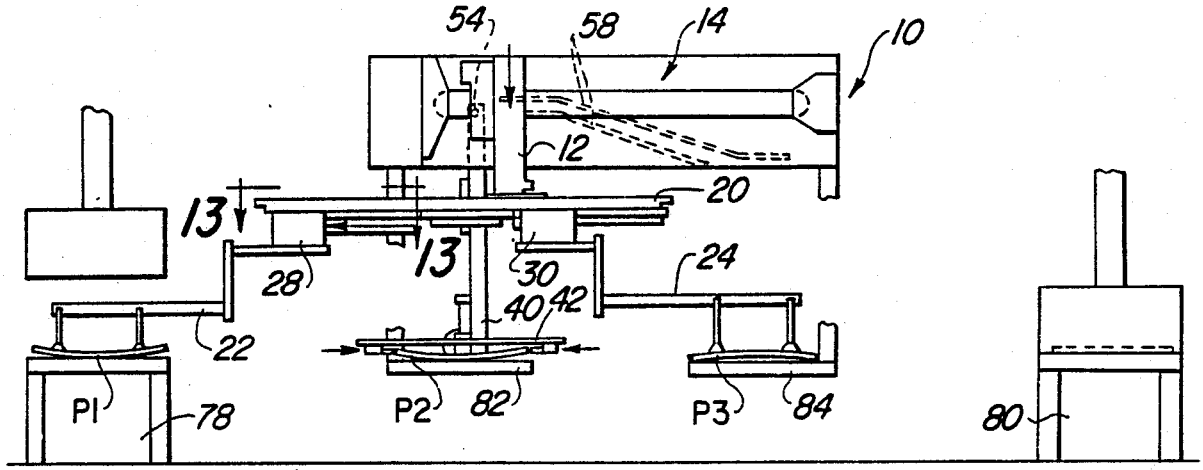

The method of operating the apparatus 10 will now be described with reference to FIGS. 5–9. Apparatus 10 is shown in FIG. 5 as a one-piece unit that can be suspended from an electric bridge 72 that rides on the overhead beams 76 normally found in production factories. The apparatus 10 thus can be easily placed at desired locations in the factory, as well as being easily removed by energizing the bridge 72 to carry the apparatus along the beam 76 to the desired location. Removal may be necessary, for example, to provide access to the presses to change the dies therein or for other purposes. In the drawings, apparatus 10 is shown positioned between two metal stamping presses 78 and 80. Presses 78 and 80 operate in a predetermined sequence to perform sequential operations on a part. The presses 78, 80 and apparatus 10 are all suitably programmed to perform the following method.

In FIG. 5, the press 78 is shown as just opening. The carriage 12 has moved transfer bar 20 to the left so that arm 22 is positioned as close as possible to the press 78 without interfering with its operation. Turnover mechanism 40 is located above a first deposit station 82 for temporarily holding a part. Similarly, transfer arm 24 is positioned above a second deposit station 84. Deposit stations 82 and 84 are preferably platforms which are stationarily connected via struts 83, 85 to the housing of the chain drive 14 so that they also form a one-piece unit and nothing is permanently mounted on the floor of the factory.

As soon as the press 78 opens, actuator 28 is energized to quickly move transfer arm 22 into the press over the part P1. Then, the drive 14 is energized to lower carriage 12 and thus all of the appendages connected to bar 20. This operation brings the finger suction cups of transfer arms 22 and 24 into contact with parts P1 and P3, respectively. Substantially simultaneously therewith, the turnover mechanism 40 is lowered so that its jaws 44 and 46 are in the plane of part P2. The jaws 44, 46 then close about the edges of part P2. Note in FIGS. 5 and 6 that the cam follower 54 is not yet restrained by the track 58. Accordingly, there is no rotation of drive pinion 64 to cause rotation of the gripper 42.

Figure 7:
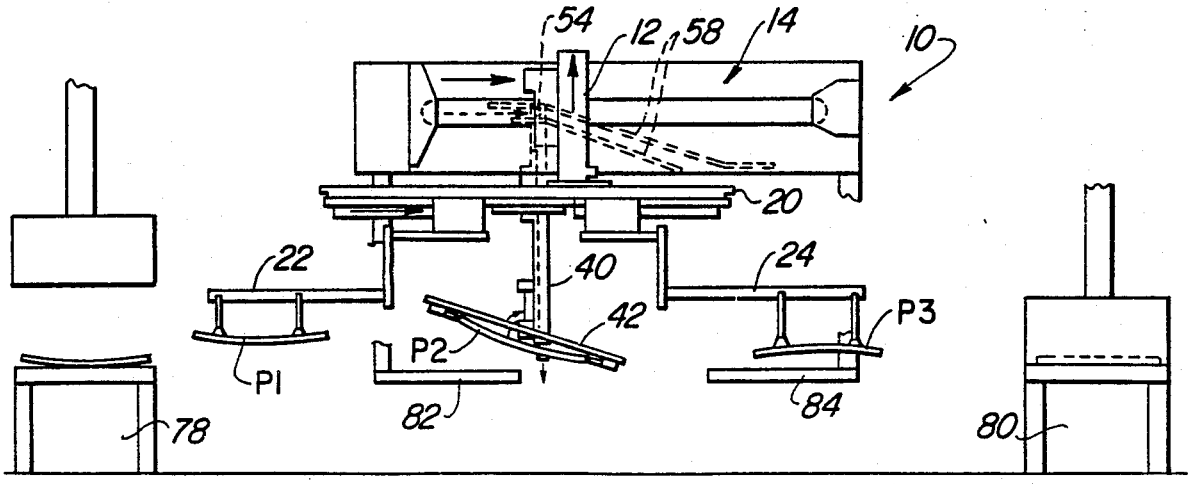

After the parts P1, P2 and P3 have been engaged, transfer bar 20 is moved upwardly and to the right towards the second press 80. As shown in FIG. 7, the horizontal movement of bar 20 causes the cam follower 52 to enter the mouth of the track 58 and begin its downward trek defined by the inclined rails of the track 58. This causes the rack 54 to move downwardly rotating pinion 64 and, thus, gripper 42.

Figure 8:
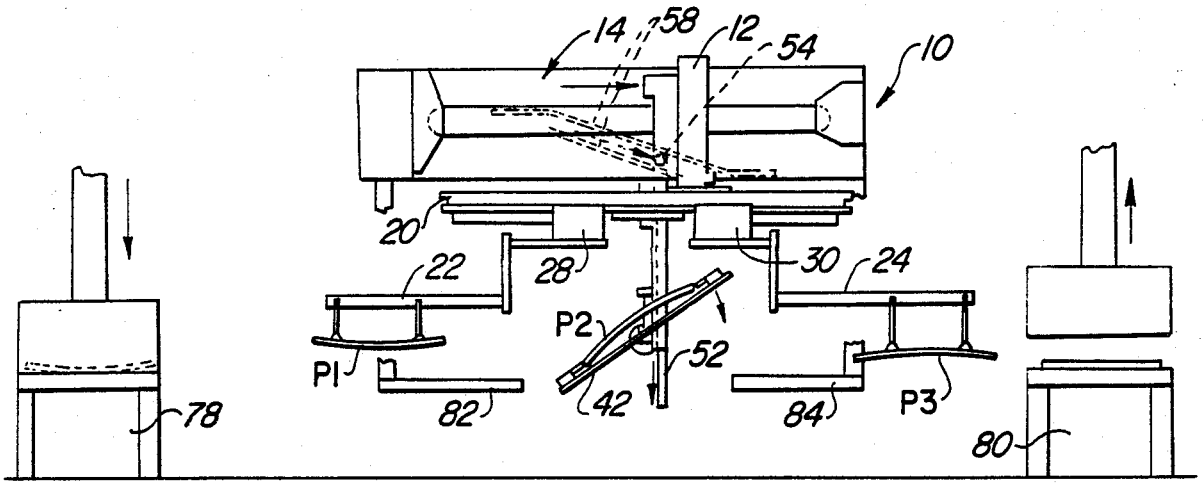
Figure 9:
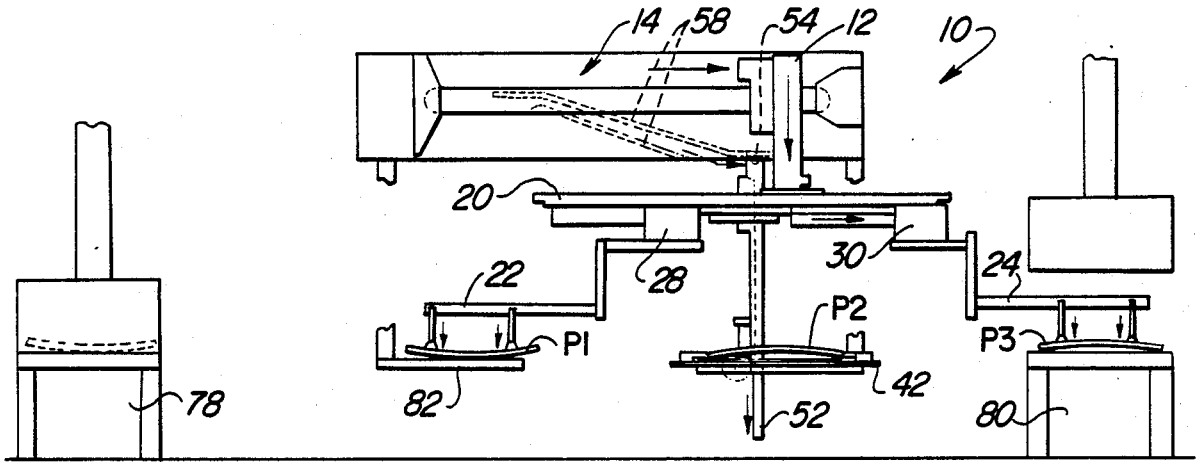

This action continues as illustrated best in FIGS. 8–9. When the transfer bar 20 has moved completely to the right, the cam follower 54 has traversed the track 58 to such an extent that a complete 180° rotation of the part P2 is made and it is positioned over the second deposit station 84. The transfer arm 24 is poised immediately adjacent press 80. When press 80 opens, actuator 30 is energized to quickly move part P3 into the open press over the lower die. As illustrated in FIG. 9, the transfer bar 20 is then moved downwardly. This action simultaneously places part P3 in the press 80, part P2 at deposit station 84 and part P1 at deposit station 82. The vacuum on the transfer arms is stopped and the gripper 42 opened to release the respective parts at these locations. Then, the transfer bar 20 is moved leftwardly to the position shown in FIG. 5 for a repeat of the foregoing sequence.

Figure 10:
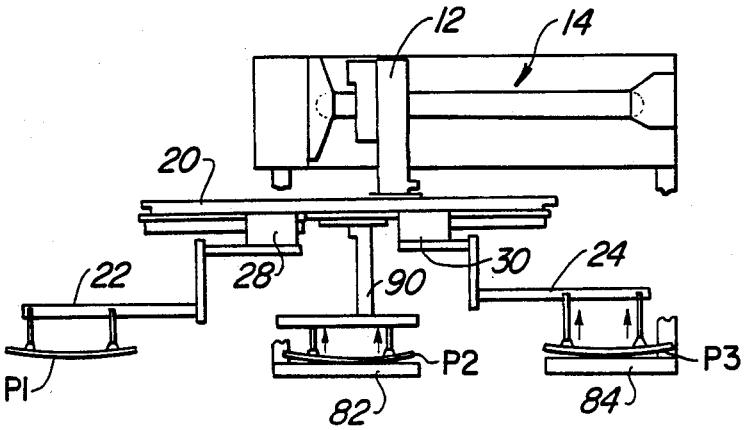
FIGS. 10 and 11 illustrate a sequence of steps during the operation of another embodiment of this invention that does not incorporate the turnover feature.
Figure 11:
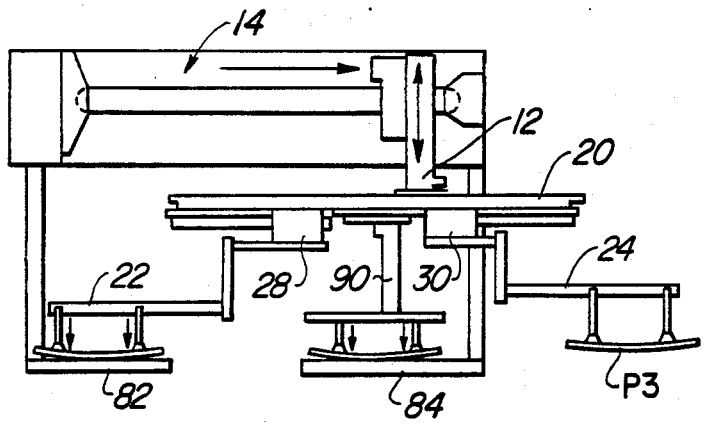

Various modifications of the preceding embodiment can be made. For example, FIGS. 10–11 illustrate the substantially identical apparatus except that no provision is made to turn over the part during transfer between the presses. Instead, an intermediate transfer arm 90 is used. Transfer arm 90 is similar to transfer arms 22 and 24 but it does not include horizontal actuators. In all other respects the embodiment of FIGS. 10 and 11 is the same as the previously described embodiment. Various other modifications will become apparent to those skilled in the art after having the benefit of studying the specification, drawings and following claims.

What is claimed is:

1. Apparatus for transferring parts between two machines, said apparatus comprising:

a movable carriage spaced above the floor;

carriage drive means for moving the carriage along generally rectilinear horizontal and vertical paths during transfer of the parts between the two machines;

a horizontal bar connected to the carriage;

first transfer arm means on one end of the bar for picking up a part in a first machine and depositing it at a first deposit station located between the two machines;

second transfer arm means on an opposite end of the bar for picking up a second part in a second deposit station and depositing the part into a second machine; and third means carried by the bar between the transfer arms for picking up a third part at the first deposit station and depositing it at the second deposit station; and said carriage drive means being operative to rectilinearly raise, horizontally rectilinearly move, and rectilinearly lower the first transfer arm, second transfer arm and third means during said picking up and depositing of said parts, for the transfer of said parts from the first machine, first deposit station, and second deposit station to the first deposit station, second deposit station, and the second machine, respectively.

2. The apparatus of claim 1 wherein said third means further comprises turnover means for inverting the part while transferring it between the first and second deposit stations.

3. The apparatus of claim 2 wherein said turnover means includes:

gripper means for temporarily gripping the part at the first deposit station and carrying it to the second deposit station; and gripper drive means for translating horizontal movement of the bar into rotational movement of the gripper means such that it pivots about a horizontal axis to invert the part as the bar is moved horizontally.

4. The apparatus of claim 3 wherein said gripper drive means comprises:

a rack having a cam follower at an upper end thereof;

stationary cam track means in which the cam follower rides during at least a portion of the horizontal movement of the bar;

pinion means driven by the rack and coupled to the gripper means for rotating the gripper means in response to vertical movement of the rack; and said cam track means being shaped to create sufficient vertical movement in the rack to cause the pinion means to rotate the gripper means 180° about a horizontal axis as the bar carries the gripper means from the first deposit station to the second deposit station.

5. The apparatus of claim 1 which further comprises:

actuator means for quickly moving the first and second transfer arms relative to the bar to thereby permit fast positioning of the arms.

6. The apparatus of claim 1 wherein the apparatus is suspended from an overhead support structure between the two machines.

7. A combination transfer/turnover apparatus for transferring parts between first and second presses while inverting the part about a horizontal axis, said apparatus comprising a unit suspended from an overhead support structure between the two presses, said unit including:

a movable carriage spaced above the floor;

carriage drive means for moving the carriage along generally rectilinear horizontal and vertical paths during transfer of the parts between presses;

a horizontally extending bar connected to the carriage and movable therewith;

a first deposit station adjacent the first press;

a second deposit station located between the first deposit station and second press;

first transfer arm means carried on one end of the bar, said first transfer arm means for picking up a part from the first press and transferring it to the first deposit station;

second transfer arm means located on the opposite end of the bar from the first transfer arm means, said second transfer arm means for picking up a part from the second deposit station and placing it in the second press;

turnover means carried by the bar between the first and second transfer arm means, said turnover means for picking up a part at the first deposit station, inverting it and depositing it at the second deposit station; and said carriage drive means being suspended above the deposit stations and being operative to rectilinearly raise, horizontally rectilinearly move, and rectilinearly lower the first transfer arm, second transfer arm and third means during said picking up and depositing of said parts, for the transfer of said parts from the first machine, first deposit station, and second deposit station to the first deposit station, second deposit station, and the second machine, respectively

8. The apparatus of claim 7 wherein the turnover means includes:

gripper means for temporarily gripping the part at the first deposit station and carrying it to the second deposit station as the bar moves towards it;

gripper drive means for translating horizontal movement of the bar into rotational movement of the gripper means such that it rotates about a horizontal axis to invert the part as the bar is moved horizontally.

9. The apparatus of claim 8 wherein said gripper drive means comprises:

a rack having a cam follower at an upper end thereof, a stationary cam track in which the cam follower rides during at least a portion of the horizontal movement of the bar;

pinion means driven by the rack and coupled to the gripper means for rotating it when the pinion is driven by vertical movement of the rack; and said cam track being shaped to create sufficient vertical movement in the rack to cause the pinion to rotate the gripper means 180° about the horizontal axis as the bar moves the gripper means from the first deposit station to the second deposit station.

10. The apparatus of claim 9 which further comprises:

first actuator means for quickly moving the first transfer arm relative to the bar to enable the arm to quickly enter the first press as soon as it opens for retrieving the part therein; and second actuator means for quickly moving the second transfer arm relative to the bar so that it can quickly enter the second press to place a part therein.

11. A method of transferring a part between a first machine and a second machine for performing sequential operations on the part, said method comprising:

suspending a transfer apparatus from overhead support structure between the first and second machines, said apparatus including a horizontally and vertically moveable bar to which first and second transfer arms are connected at opposite ends and a turnover mechanism connected to the bar between the transfer arms;

providing a first deposit station adjacent the first machine;

providing a second deposit station between the first deposit station and the second machine;

moving the bar towards the first machine until the first transfer arm is adjacent the first machine, the turnover mechanism is located above the first deposit station and the second transfer arm located above the second deposit station;

inserting the first transfer arm into the first machine;

lowering the bar;

using the first transfer arm, said turnover mechanism and said second transfer arms to hold parts located in the first machine, respectively;

lifting the bar and moving it towards the second machine;

using the turnover mechanism to invert the part held by it as the bar travels towards the second machine;

inserting the second transfer arm into the second machine;

lowering the bar; and releasing the parts from the first transfer arm, the turnover mechanism and second transfer arm to deposit the parts in the first deposit station, second deposit station and second machine, respectively.

12. The method of claim 11 wherein the apparatus is suspended from an electric bridge riding on overhead beams, and wherein the method further comprises:

using the electric bridge to move the apparatus to provide access to the machines.

* * * * *